US011377253B2

(12) United States Patent
Valencia et al.

(10) Patent No.: US 11,377,253 B2
(45) Date of Patent: Jul. 5, 2022

(54) PACKAGES HAVING OCTAGONAL AUTOBOTTOMS AND BLANKS THEREFOR

(71) Applicant: WestRock Shared Services, LLC, Atlanta, GA (US)

(72) Inventors: John Valencia, Johns Creek, GA (US); Jesus A. Padilla, Hoschton, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 17/105,203

(22) Filed: Nov. 25, 2020

(65) Prior Publication Data

US 2021/0155364 A1 May 27, 2021

Related U.S. Application Data

(60) Provisional application No. 62/940,577, filed on Nov. 26, 2019.

(51) Int. Cl.

| | |
|---|---|
| ***B65D 5/36*** | (2006.01) |
| ***B65D 5/66*** | (2006.01) |
| ***B65D 5/02*** | (2006.01) |
| ***B65D 5/64*** | (2006.01) |

(52) U.S. Cl.

CPC ..... *B65D 5/029* (2013.01); *B65D 5/0227* (2013.01); *B65D 5/0254* (2013.01); *B65D 5/3628* (2013.01); *B65D 5/64* (2013.01); *B65D 5/6602* (2013.01)

(58) Field of Classification Search

CPC ..... B65D 5/36–3628; B65D 5/029

USPC ..... 229/109, 117

See application file for complete search history.

(56) References Cited

U.S. PATENT DOCUMENTS

| | | | | |
|---|---|---|---|---|
| 4,199,098 | A * | 4/1980 | Lopez | B65D 5/06 229/108.1 |
| 4,549,690 | A * | 10/1985 | Rosenburg | B65D 5/3621 229/109 |
| 2013/0327818 | A1* | 12/2013 | Schultz | B65D 77/062 229/117 |

FOREIGN PATENT DOCUMENTS

| | | | | |
|---|---|---|---|---|
| DE | 20308539 | U1 * | 9/2003 | B65D 5/3621 |
| EP | 1404581 | A2 * | 4/2004 | B65D 5/029 |
| GB | 2243596 | A * | 11/1991 | B65D 5/0227 |
| GB | 2313826 | A * | 12/1997 | B65D 5/3621 |

OTHER PUBLICATIONS

Machine Translation of EP 1 404 581 B1 (Year: 2004).*

* cited by examiner

*Primary Examiner* — Nathan J Newhouse
*Assistant Examiner* — Phillip D Schmidt
(74) *Attorney, Agent, or Firm* — Neil G. Cohen

(57) ABSTRACT

In accordance with at least one aspect of this disclosure, a package can include an octagonal side body formed of at least eight body panels and an autobottom connected to the octagonal side body and formed of a plurality of bottom panels extending from a respective body panel of the plurality of the at least eight body panels. The autobottom can connect all of the at least eight body panels together in an octagonal shape when the plurality of bottom panels are interacting with each other.

20 Claims, 12 Drawing Sheets

PACKAGES HAVING OCTAGONAL AUTOBOTTOMS AND BLANKS THEREFOR

CROSS-REFERENCE TO RELATED APPLICATIONS

This application claims priority to and the benefit of U.S. Provisional Application No. 62/940,577, filed Nov. 26, 2019, the entire contents of which are herein incorporated by reference in their entirety.

FIELD

This disclosure relates to packages, e.g., having autobottoms that form when the package is formed.

BACKGROUND

Existing packages are limited in shape complexity while still allowing autobottoms as the geometric complexity forbids simple autobottom formation as in a square package, for example.

Such conventional methods and systems have generally been considered satisfactory for their intended purpose. However, there is still a need in the art for packages having octagonal autobottoms and blanks therefor. The present disclosure provides a solution for this need.

SUMMARY

In accordance with at least one aspect of this disclosure, a package can include an octagonal side body formed of at least eight body panels and an autobottom connected to the octagonal side body and formed of a plurality of bottom panels extending from a respective body panel of the plurality of the at least eight body panels. The autobottom can connect all of the at least eight body panels together in an octagonal shape when the plurality of bottom panels are interacting with each other.

The autobottom can be configured to fully enclose a bottom opening of the package, for example. Any other suitable amount of closure is contemplated herein. The autobottom can fit entirely within the octagonal shape such that no portion of the autobottom extends laterally outside of the at least eight body panels when the plurality of bottom panels are interacting with each other.

In certain embodiments, the at least eight body panels are not the same width such that the octagonal side body forms an irregular octagon for the octagonal shape. In certain embodiments, at least eight of the at least eight body panels can be the same width such that the octagonal side body forms a regular octagon for the octagonal shape.

The package can further comprise a top configured to at least partially enclose a top opening that is defined by the at least eight body panels and is opposite relative to the bottom opening. The top can be foldably connected to a body panel of the at least eight body panels to fold relative to the body panels to selectively cover the top opening.

One or more body panels of the at least eight body panels can include a latching portion configured to receive a latch connected to the top to latch the top to the one or more body panels. Each latching portion can be foldably connected to the respective body panel of the one or more body panels. A pair of latching portions can be configured to receive a latch tab in a space defined between the pair of latching portions.

In accordance with at least one aspect of this disclosure, a blank can be configured to form any embodiment of a package in accordance with this disclosure. For example, a blank for a package can include at least eight body panels connected by a respective body fold line between each body panel and configured to form an octagonal shape, and a plurality of bottom panels, a respective bottom panel of the plurality of bottom panels foldably connected to a respective body panel of the at least eight body panels. The plurality of bottom panels can be configured to form an autobottom that at least partially forms a bottom of the package. The autobottom can connect all of the at least eight body panels together in an octagonal shape when the plurality of bottom panels are interacting with each other. In certain embodiments, the autobottom can be configured to automatically form the bottom when the body panels are moved to be in the octagonal shape.

In certain embodiments, the body panels can each have a rectangular shape. The plurality of bottom panels can include a first, second, third, fourth, fifth, sixth, seventh, and eighth bottom panel, each extending from a respective first, second, third, fourth, fifth, sixth, seventh, and eighth body panel of the at least eight body panels.

The octagonal shape can be an irregular symmetric octagon. The first bottom panel can include an irregular, double peak shape, for example. The second bottom panel can include straight sides that form the octagonal shape to align with each body panel, for example. The third bottom panel can be an irregular shape with straight sides extending from the third body panel at an angle. The fourth bottom panel can be a triangle shape. The fifth bottom panel can have an irregular partial octagonal shape. The sixth bottom panel can have an irregular, double peak shape. The seventh bottom panel can have an irregular shape with straight sides extending from the seventh body panel at an angle similar to the third bottom panel. The eighth bottom panel can be a triangle shape similar to the fourth bottom panel.

In certain embodiments, the first, second, fourth, sixth, and eighth bottom panels have glue disposed thereon. The first body panel can have glue disposed thereon and the blank can further include a ninth body panel foldably connected to the eighth body panel and not having a bottom panel connected thereto. The ninth body panel can be configured to be attached to the first body panel.

In certain embodiments, the octagonal shape can be a regular octagon. The first bottom panel can include an irregular, double peak shape. The second bottom panel can include straight sides that at least partially form the octagonal shape to align with each body panel. The third bottom panel can be an irregular shape with straight sides extending from the third body panel at an angle. The fourth bottom panel can be a triangle shape. The fifth bottom panel can have an irregular partial octagonal shape. The sixth bottom panel has an irregular, double peak shape. The seventh bottom panel can be an irregular shape with straight sides extending from the seventh body panel at an angle similar to the third bottom panel and a spring tab foldably connected to the seventh bottom panel. The eighth bottom panel can be a triangle shape similar to the fourth bottom panel, for example. Any other suitable panel shapes to form an octagonal autobottom for a regular or irregular octagonal shape are contemplated herein.

The first, second, fourth, sixth, and eighth bottom panels can have glue disposed thereon. In certain embodiments, the blank can include an attachment tab foldably connected to the first body panel and configured to connect to the eighth body panel.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
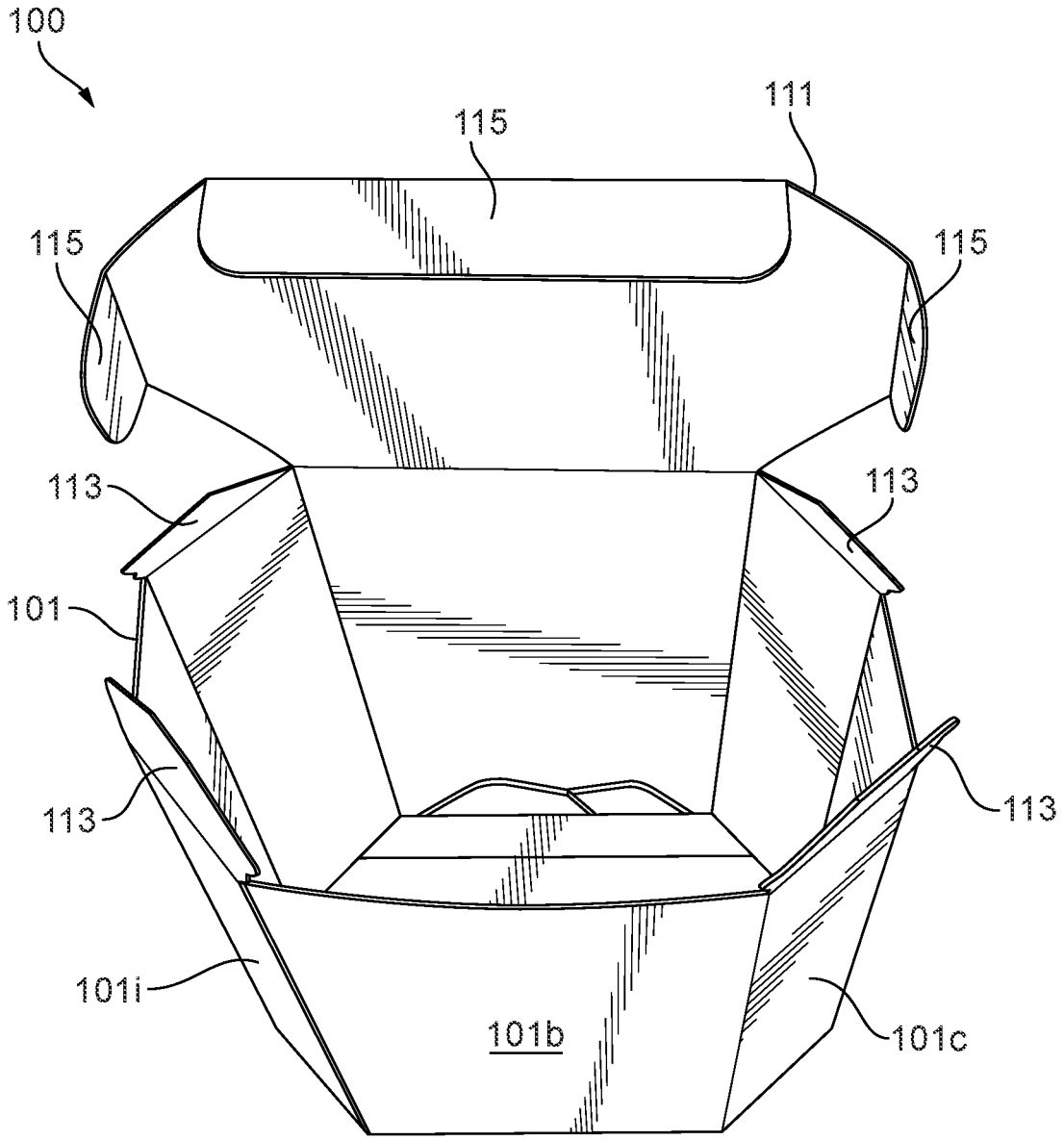
FIG. 1A is a top perspective view of an embodiment of a package in accordance with this disclosure, shown having a top in an open state.

Reference will now be made to the drawings wherein like reference numerals identify similar structural features or aspects of the subject disclosure. For purposes of explanation and illustration, and not limitation, an illustrative view of an embodiment of a package in accordance with the disclosure is shown in FIGS. 1A and 1*s* designated generally by reference character 100. Other embodiments and/or aspects of this disclosure are shown in FIGS. 1B-7. Certain embodiments described herein can be used as easy-to-assembly packaging for any suitable purpose (e.g., retail, shipping, etc.).

Figure 1B:
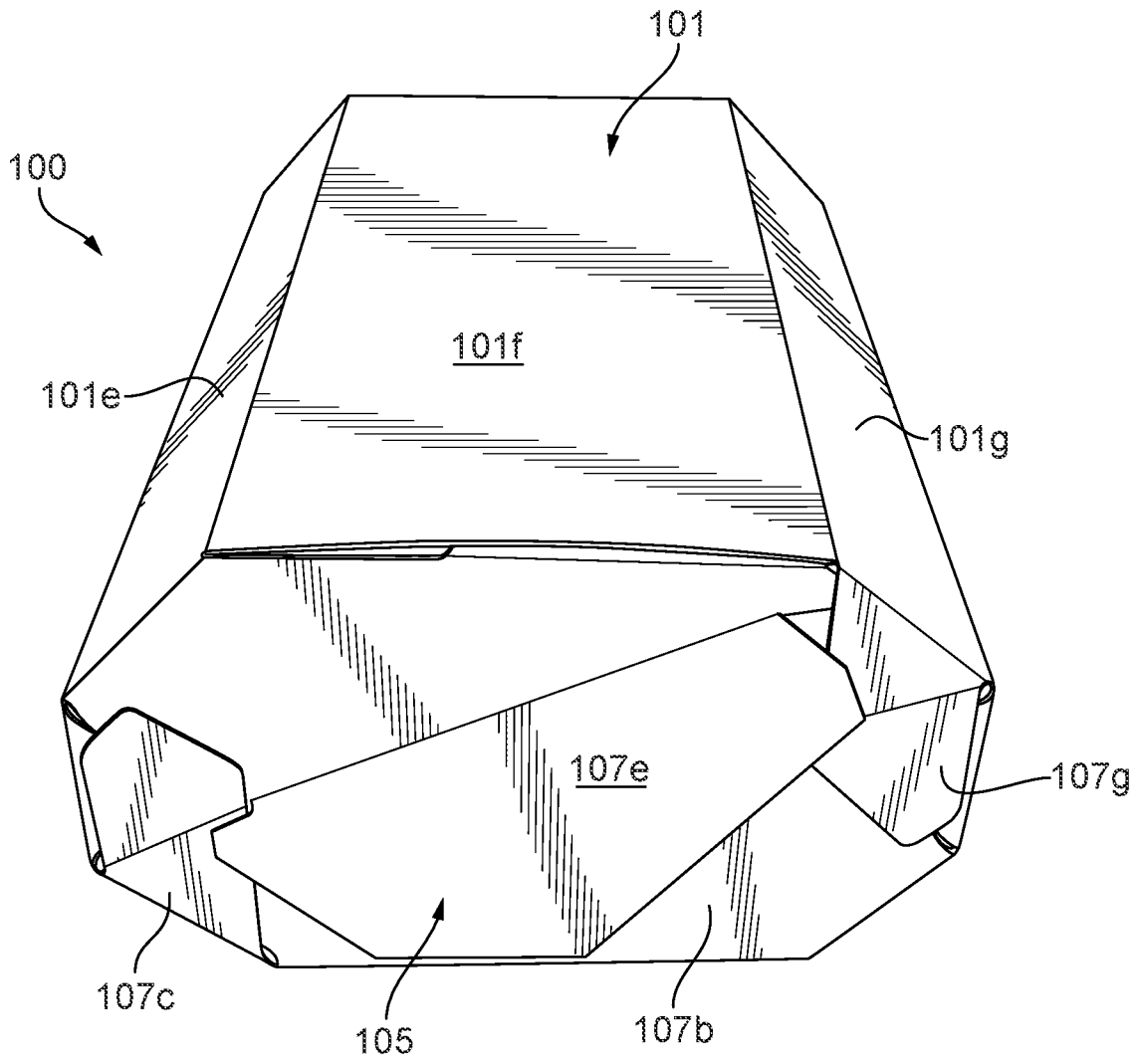
FIG. 1B is a bottom perspective view of the embodiment of FIG. 1A, showing an assembled octagonal autobottom of the package.
Figure 2:
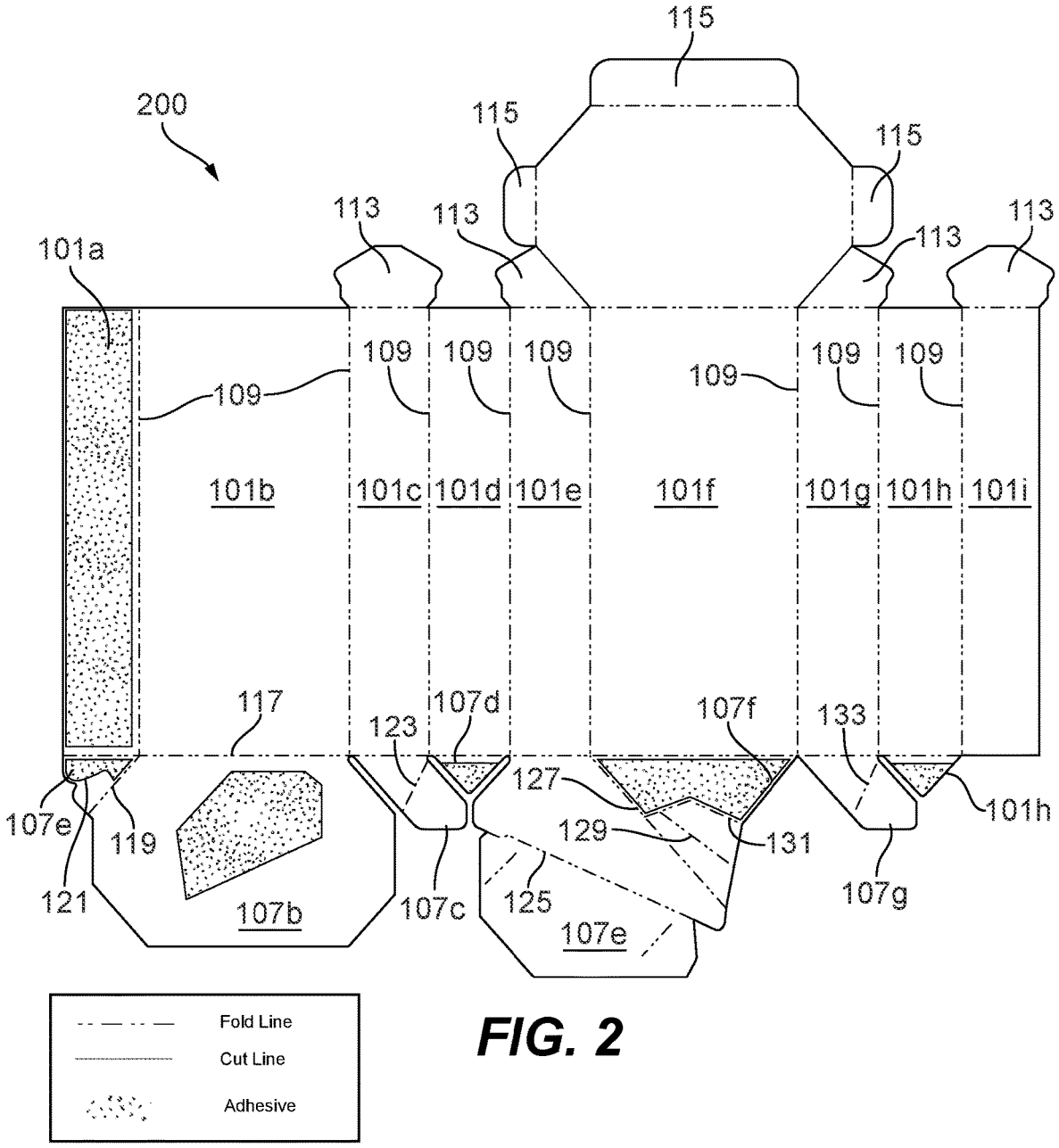
FIG. 2 is a plan view of an embodiment of a blank configured to form the embodiment of a package of FIGS. 1A and 1B.

Referring to FIGS. 1A, 1B, and 2, a package 100 can include an octagonal side body 101 formed of at least eight body panels 101*a, b, c, d, e, f, g, h* and an autobottom 105 connected to the octagonal side body 101. The autobottom 105 can be formed of a plurality of bottom panels 107*a, b, c, d, e, f, g, h* extending from a respective body panel 101*a-h* of the plurality of the at least eight body panels. The autobottom 105 can connect all of the at least eight body panels 101*a-h* together in an octagonal shape when the plurality of bottom panels 107*a-h* are interacting with each other. The plurality of body panels 101*a-i* can be defined by one or more body fold lines 109.

The autobottom 105 can be configured to fully enclose a bottom opening (not shown) of the package 100, for example. Any other suitable amount of closure (e.g., partial enclosure) is contemplated herein. The autobottom 105 can fit entirely within the octagonal shape such that no portion of the autobottom 105 extends laterally outside of the at least eight body panels 101*a-i* when the plurality of bottom panels 107*a-h* are interacting with each other.

In certain embodiments, e.g., as shown in FIGS. 1A and 1B, the at least eight body panels 101*a-h* are not the same width such that the octagonal side body 101 forms an irregular octagon for the octagonal shape. Other embodiments of packages 300, 500 are shown in FIGS. 3A-3C and 5A-5C. In certain embodiments, e.g., as shown in FIGS. 3A-3C and 5A-5C, at least eight body panels 301*a-h*, 501*a-h* of the at least eight body panels 301*a-h*, 501*a-h* can be the same width such that the octagonal side body 101 forms a regular octagon (an octagon of equal length sides) for the octagonal shape.

Figure 3A:
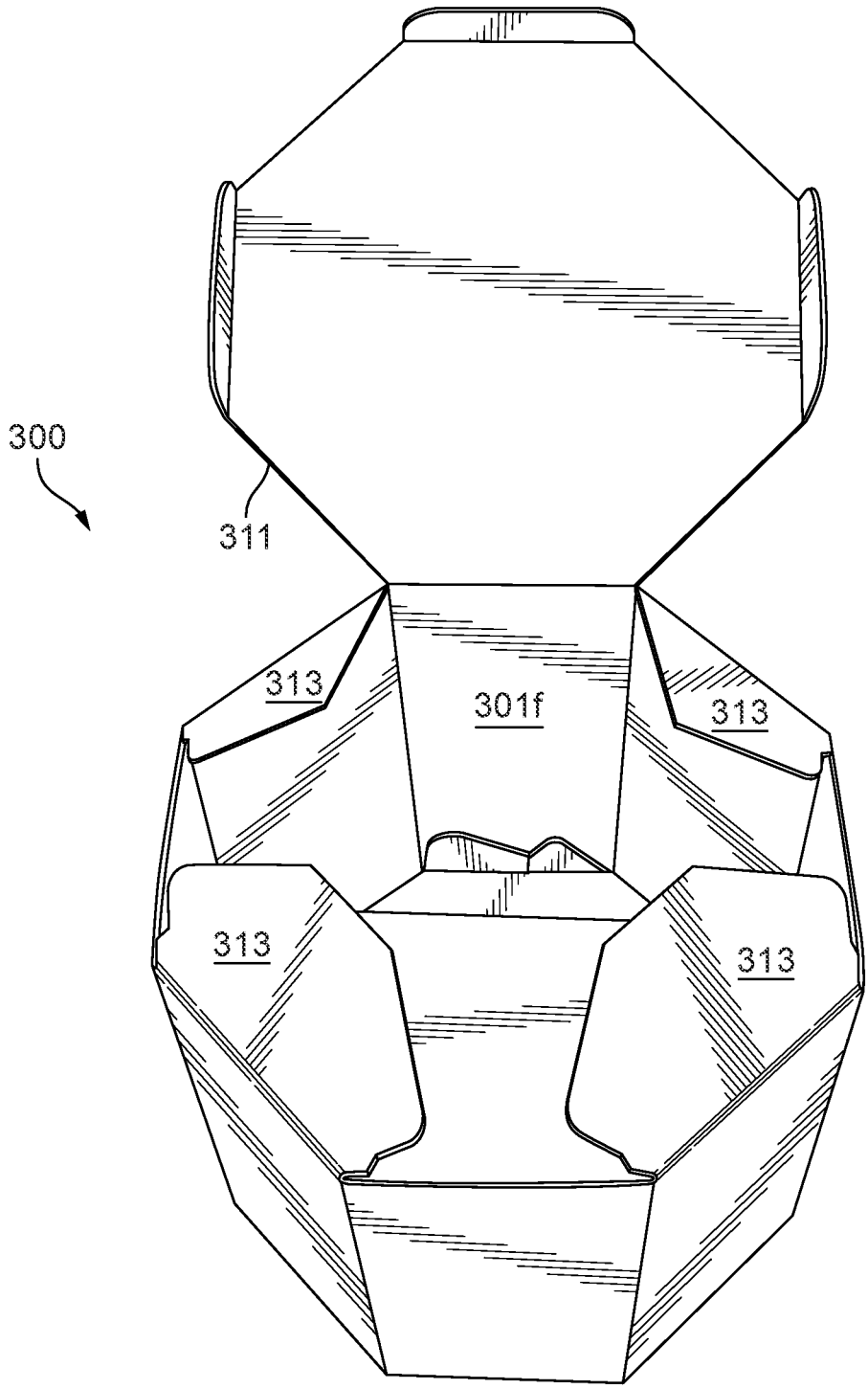
FIG. 3A is a top perspective view of an embodiment of a package in accordance with this disclosure, shown having a top in an open state.
Figure 3B:
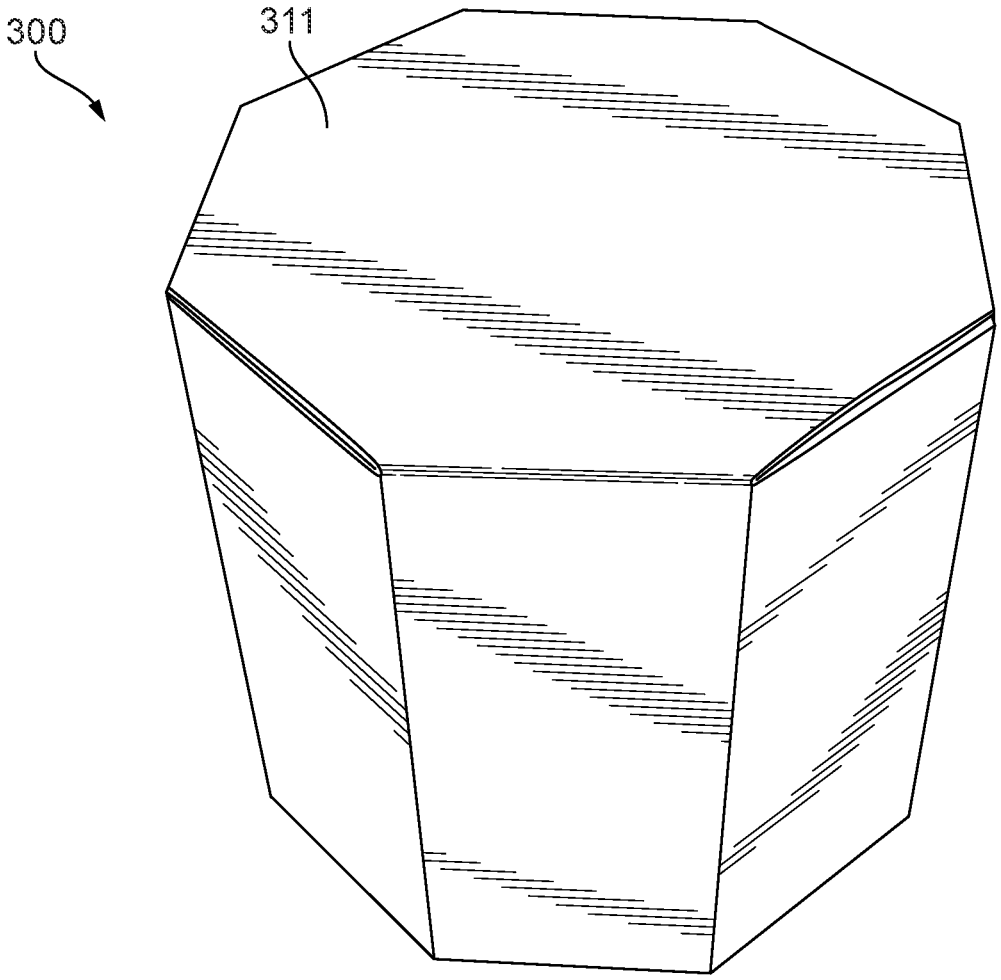
FIG. 3B is a top perspective view of the embodiment of FIG. 3A, shown having a top in a closed state.
Figure 3C:
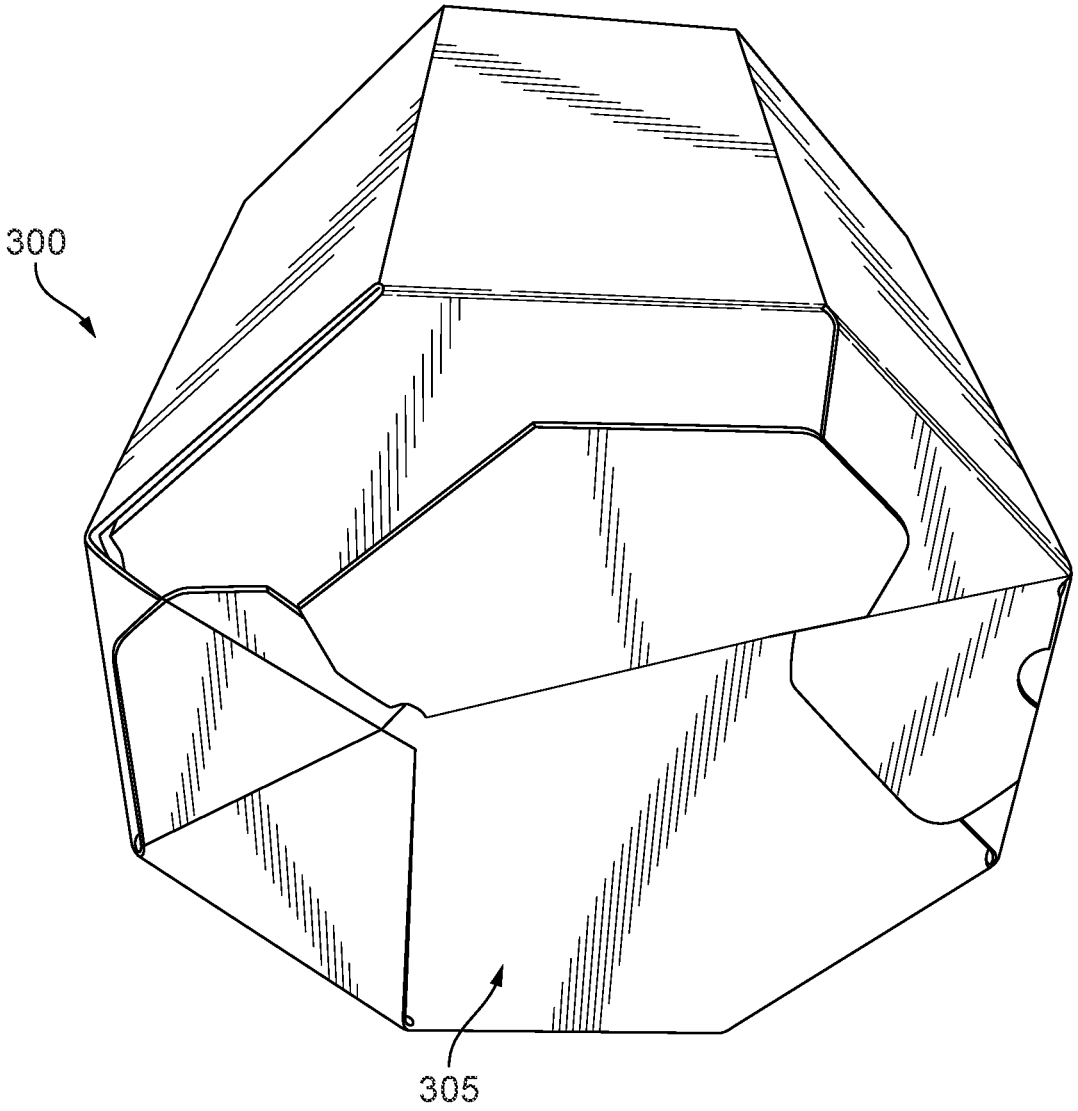
FIG. 3C is a bottom perspective view of the embodiment of FIG. 3A, showing an assembled octagonal autobottom of the package.
Figure 4:
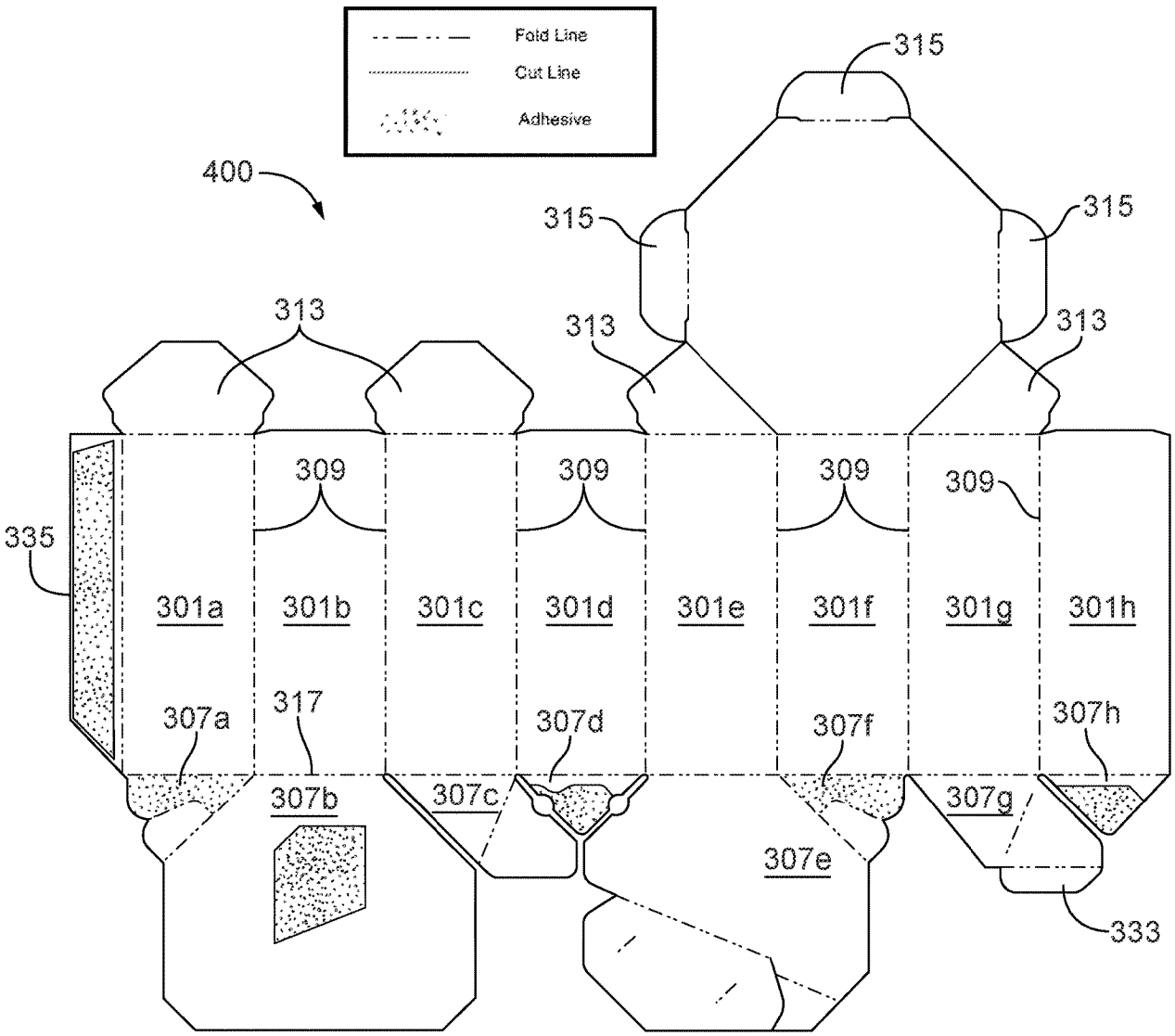
FIG. 4 is a plan view of an embodiment of a blank configured to form the embodiment of a package of FIGS. 3A-3C.
Figure 5A:
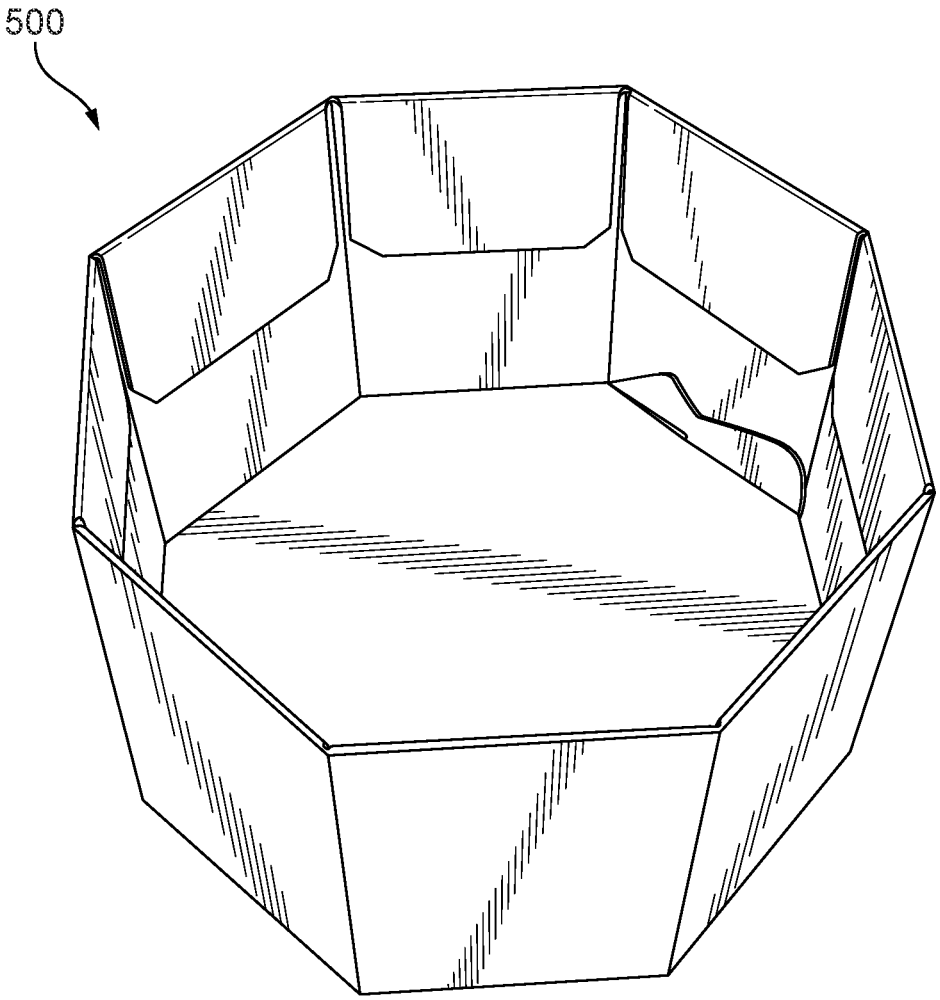
FIG. 5A is a top perspective view of an embodiment of a package in accordance with this disclosure, shown not having a top disposed thereon.

Referring to FIGS. 1A-7, the package 100, 300, 500 can further comprise a top 111, 311, 511 configured to at least partially enclose a top opening (e.g., as shown in FIGS. 1A, 3A, and 5A) that is defined by the at least eight body panels 101*a-h*, 301*a-h*, 501*a-h* and is opposite relative to the bottom opening. As shown in the embodiments of FIGS. 1A and 3A, the top 111, 311 can be foldably connected to a body panel (e.g., panels 101*f*, 301*f* as shown) of the at least eight body panels 101*a-h*, 301*a-h* to fold relative to the body panels 101*f*, 301*f* to selectively cover the top opening.

As shown in the embodiments of FIGS. 1A and 3A, one or more body panels 101*c*, 101*e*, 101*g*, 101*i*, 301*a*, 301*c*, 301*e*, 301*g* of the at least eight body panels 101*a-h*, 301*a-h* can include a latching portion 113, 313 configured to receive a latch 115, 315 connected to the top 111, 311 to latch the top 111, 311 to the one or more body panels 101*a-h*, 301*a-h* (e.g., to selectively enclose the package 100, 300. Each latching portion 113, 313 can be foldably connected to the respective body panel 101*c*, 101*e*, 101*g*, 101*i*, 301*a*, 301*c*, 301*e*, 301*g* of the one or more body panels 101*a-h*, 301*a-h*. As shown, in certain embodiments, the latching portions 113, 313 can be disposed on alternating body panels 101*a-h*, 301*a-h*. A pair of latching portions 113, 313 can be configured to receive a latch tab 115, 315 in a space defined between the pair of latching portions 113, 313 (e.g., and interact with the latching portions 113, 313 to retain the top 111, 311 in the closed position).

Figure 5B:
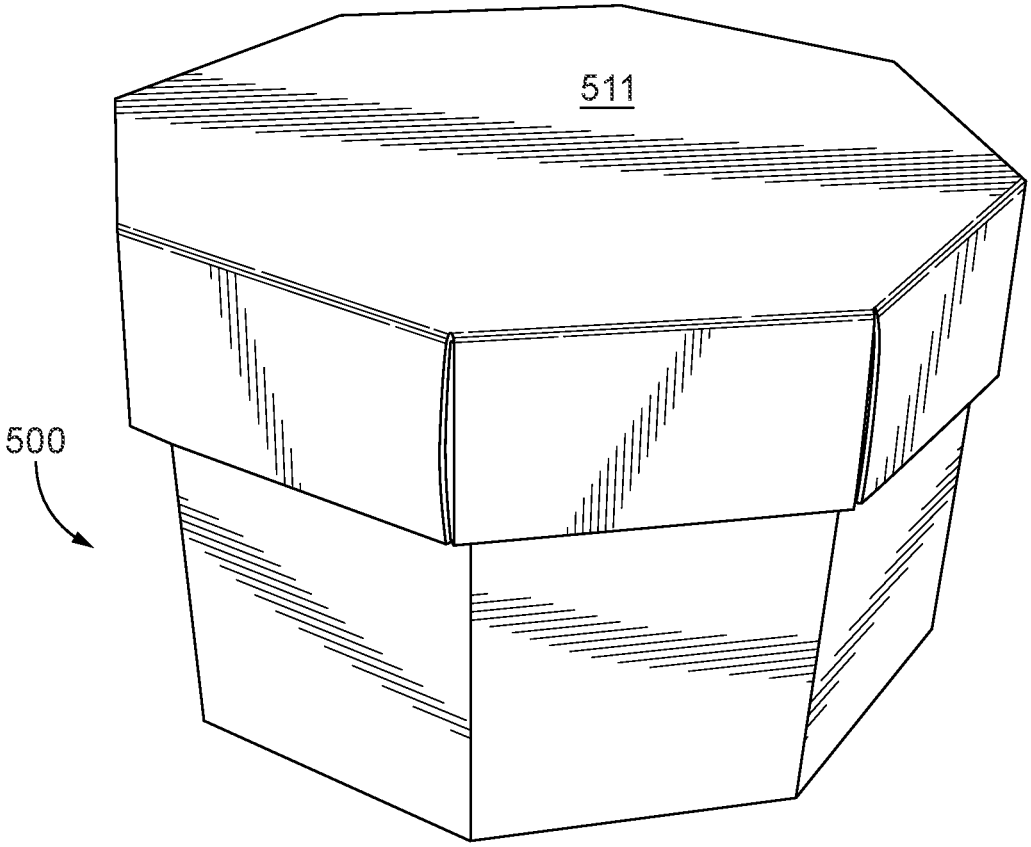
FIG. 5B is a top perspective view of the embodiment of FIG. 5A, shown having a separate octagonal top disposed thereon to enclose the package.
Figure 5C:
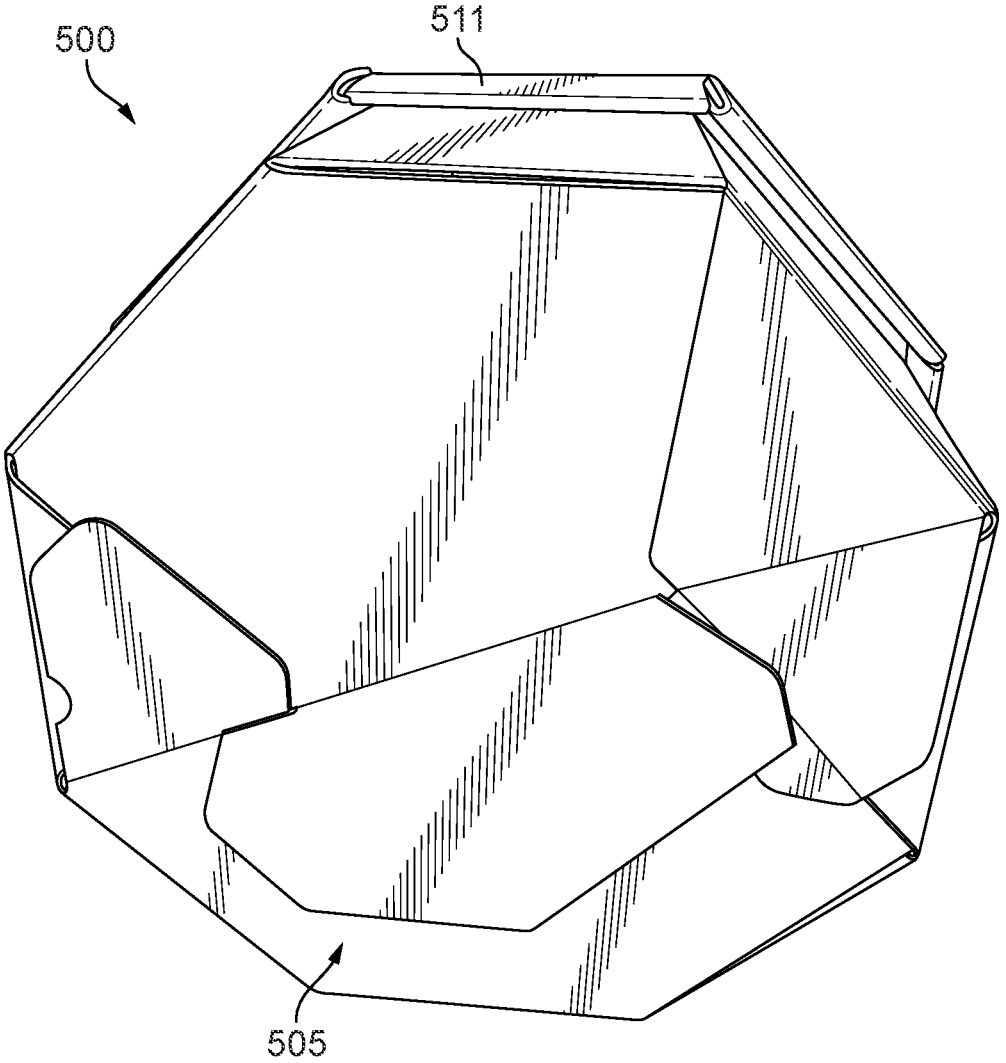
FIG. 5C is a bottom perspective view of the embodiment of FIG. 5A, showing an assembled octagonal autobottom of the package.
Figure 6:
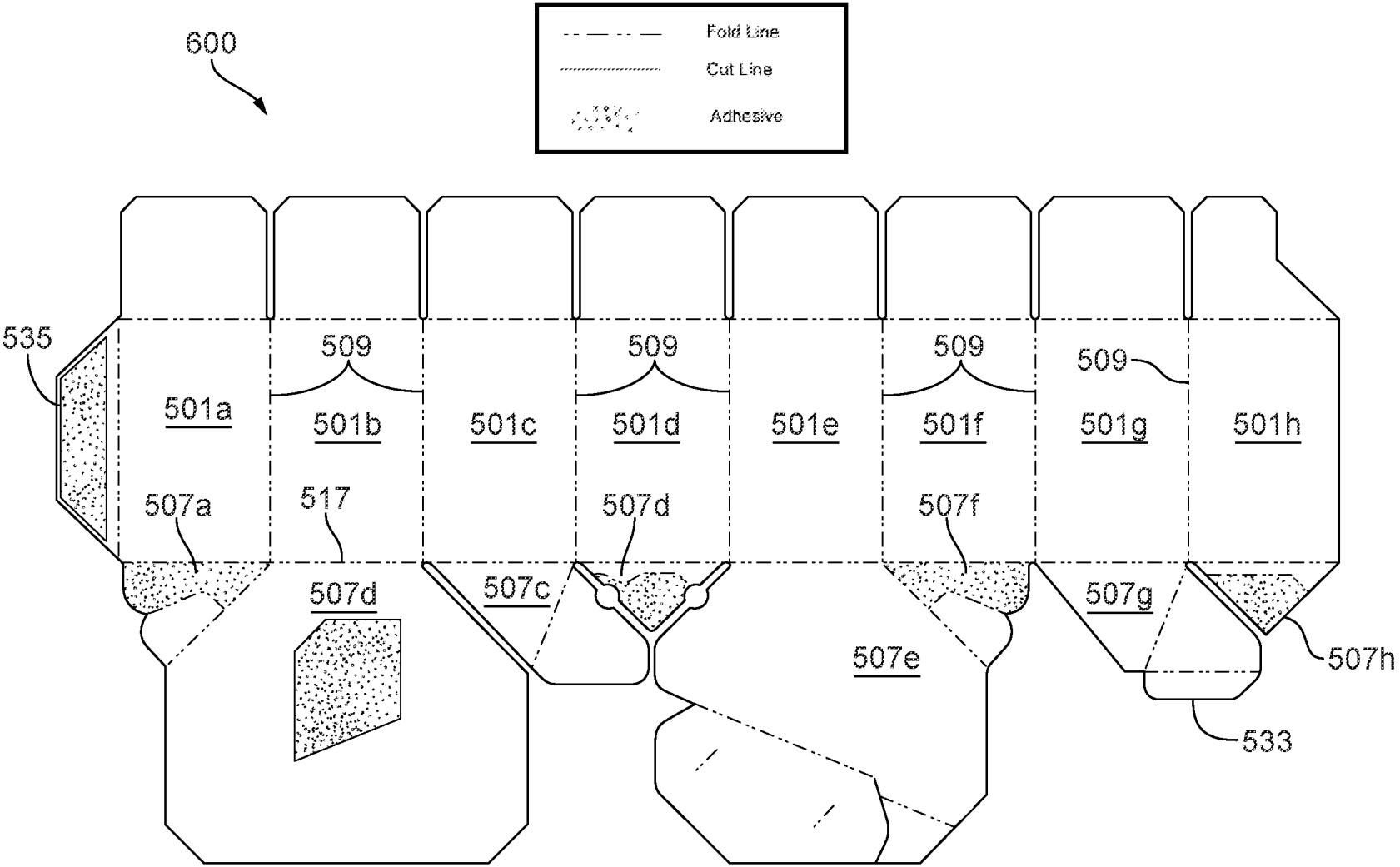
FIG. 6 is a plan view of an embodiment of a blank configured to form the embodiment of a package of FIGS. 5A-5C.

Referring to FIGS. 5A-6, in certain embodiments, the top 511 can be a separate item that is removable. For example, the top 511 can be placed over the body panels 501*a-h* to enclose the package 500, e.g., as shown in FIG. 5B.

Embodiments of a package can be formed from a blank. A blank can be made from any suitable material (e.g., paper, paperboard, plasticboard, corrugated board, etc.).

In accordance with at least one aspect of this disclosure, referring to FIGS. 2, 4, and 6 a blank 200, 400, 600 can be configured to form any suitable embodiment of a package (e.g., 100, 300, 500) in accordance with this disclosure. For example, a blank 200, 400, 600 for a package can include at least eight body panels 101*a-i*, 301*a-h*, 501*a-h* connected by a respective body fold line 109, 309, 509 between each body panel 101*a-h*, 301*a-h*, 501*a-h* and configured to form an octagonal shape. The blank 200, 400, 600 can include a plurality of bottom panels 107*a-h*, 307*a-h*, 507*a-h*. A respective bottom panel 107*a-h*, 307*a-h*, 507*a-h* of the plurality of bottom panels 107*a-h*, 307*a-h*, 507*a-h* can be foldably connected to a respective body panel 101*a-h*, 301*a-h*, 501*a-h* of the at least eight body panels 101*a-h*, 301*a-h*, 501*a-h*. The plurality of bottom panels 107*a-h*, 307*a-h*, 507*a-h* can be configured to form an autobottom 105, 305, 505 (e.g., as described above) that at least partially forms a bottom of the package 100, 300, 500. The autobottom 105, 305, 505 can connect all of the at least eight body panels 101*a-h*, 301*a-h*, 501*a-h* together in an octagonal shape when the plurality of bottom panels 107*a-h*, 307*a-h*, 507*a-h* are interacting with each other (e.g., mechanically connected, glued, or otherwise interacting). In certain embodiments, the autobottom 105, 305, 505 can be configured to automatically form the bottom when the body panels 101*a-h*, 301*a-h*, 501*a-h* are moved to be in the octagonal shape (e.g., after an initial assembly of the blank 200, 400, 600).

In certain embodiments, the body panels 101*a-h*, 301*a-h*, 501*a-h* can each have a rectangular shape, e.g., as shown. The plurality of bottom panels 107*a-h*, 307*a-h*, 507*a-h* can include a first bottom panel 107*a*, 307*a*, 507*a*, a second bottom panel 107*b*, 307*b*, 507*b*, a third bottom panel 107*c*, 307*c*, 507*c*, a fourth bottom panel 107*d*, 307*d*, 507*d*, fifth bottom panel 107*e*, 307*e*, 507*e*, sixth bottom panel 107*f*, 307*f*, 507*f*, a seventh bottom panel 107*g*, 307*g*, 507*g*, and eighth bottom panel 107*h*, 307*h*, 507*h*. Each bottom panel 107*a-h*, 307*a-h*, 507*a-h* can extend from a respective first, second, third, fourth, fifth, sixth, seventh, and eighth body panel 101*a-h*, 301*a-h*, 501*a-h* of the at least eight body panels 101*a-h*, 301*a-h*, 501*a-h*, e.g., as shown. Each bottom panel 107*a-h*, 307*a-h*, 507*a-h* can be connected to each body panel 101*a-h*, 301*a-h*, 501*a-h* at a fold line 117, 317, 517.

In certain embodiments, e.g., as shown in FIGS. 1A-2, the octagonal shape can be an irregular symmetric octagon (e.g., having sides with different widths). The first bottom panel 107*a* can include an irregular, double peak shape, e.g., as shown. The second bottom panel 107*b* can include straight sides that form the octagonal shape to align with each body panel 101*a-h*, when assembled, for example. In certain embodiments, the first bottom panel 107*a* and the second bottom panel 107*b* can be connected at a first line 119 (e.g., a foldable line such as a perforated line). The first bottom panel 107*a* can include a second fold line 121.

The third bottom panel 107*c* can be an irregular shape with straight sides extending from the third body panel 101*c* at an angle. The third bottom panel 107*c* can include a third line 123 running across the panel 107*c* (e.g., a foldable line such as a perforated line).

The fourth bottom panel 107*d* can be a triangle shape, for example. The fifth bottom panel 107*e* can have an irregular partial octagonal shape as shown. In certain embodiments, the fifth bottom panel 107*e* can include a fourth line 125 (e.g., a foldable line such as a perforated line) running across the fifth bottom panel 107*e* as shown. The fifth bottom panel 107*e* can also include a fifth fold line 127 and a sixth fold line 129.

The sixth bottom panel 107*f* can have an irregular, double peak shape. The fifth bottom panel 107*e* and the sixth bottom panel 107*f* can be connected at a seventh line 131 (e.g., a foldable line such as a perforated line).

The seventh bottom panel 107*g* can have an irregular shape with straight sides extending from the seventh body panel 101*g* at an angle, e.g., similar to the third bottom panel 107*c* for example. The eighth bottom panel 107*h* can be a triangle shape similar to the fourth bottom panel 107*d*, for example.

In certain embodiments, the first, second, fourth, sixth, and eighth bottom panels 107*a, b, d, f, h* can have glue disposed thereon. Glue is shown has hatching in FIGS. 2, 4, and 6. The first body panel 101*a* can have glue disposed thereon and the blank 200 can further include a ninth body panel 101*i* foldably connected to the eighth body panel 101*h*. The ninth body panel 101*i* may not having a bottom panel connected thereto. The ninth body panel 101*i* can be configured to be attached to the first body panel 101*a*, e.g., via glue on the first body panel 101*a*.

In certain embodiments, e.g., as shown in FIGS. 3A-6, the octagonal shape can be a regular octagon. The bottom panels 307*a-h*, 507*a-h* can be generally similar to the body panels 107*a-h* as described above. For example, the first bottom panel 307*a*, 507*a* can include an irregular, double peak shape. The second bottom panel 307*b*, 507*b* can include straight sides that at least partially form the octagonal shape to align with each body panel. The third bottom panel 307*c*, 507*d* can be an irregular shape with straight sides extending from the third body panel 301*c*, 501*c* at an angle. The fourth bottom panel 307*d*, 507*d* can be a triangle shape. The fifth bottom panel 307*e*, 507*e* can have an irregular partial octagonal shape. The sixth bottom panel 307*f*, 507*f* can have an irregular, double peak shape.

The seventh bottom panel 307*g*, 507*g* can be an irregular shape with straight sides extending from the seventh body panel 301*g*, 501*g* at an angle similar to the third bottom panel 307*c*, 507*c*. The seventh bottom panel 307*g*, 507*g* can include a spring tab 333, 533 foldably connected to the seventh bottom panel 307*g*, 507*g*, e.g., as shown. The spring tab 333, 533 can fold up into the body panels to allow another tab to slide in and lock.

The eighth bottom panel 307*h*, 507*h* can be a triangle shape similar to the fourth bottom panel 307*d*, 507*d*, for example. As shown in FIGS. 4 and 6, the first, second, fourth, sixth, and eighth bottom panels can have glue disposed thereon.

In certain embodiments, the blank 400, 600 can include an attachment tab 335, 535 foldably connected to the first body panel 301*a*, 501*a* and configured to connect to the eighth body panel 301*h*, 501*h* (e.g., using glue to adhere the eighth body panel 301*h*, 501*h* over the attachment tab 335, 535. The attachment tab 335, 535 can include glue disposed thereon, e.g., as shown.

The blank 200, 400, 600 can include any other suitable panels for any other suitable function (e.g., locking portions, a top, locking tabs as described above). For example, e.g., as shown in FIG. 6, a blank 600 can include one or more upper foldover reinforcing tabs for attaching to an inner surface of the body panels. The blanks 200, 400, 600 can be assembled as appreciated by those having ordinary skill in the art in view of this disclosure without undue experimentation. For example, the first bottom panels 107*a*, 307*b*, 507*b* and the sixth bottom panels 107*f*, 307*f*, 507*f* can be folded up and glued to an inner surface of the first body panels 101*a*, 301*a*, 501*a* and the sixth body panels 101*f*, 301*f*, 501*f*, respectively. One or more of the remaining panels can be interfered together and/or glued together in a manner that forms the autobottom as shown (e.g., in FIGS. 1B, 3C, and 5C).

While certain panel shapes are shown in the Figs., any other suitable panel shapes to form an octagonal autobottom for a regular or irregular octagonal shape are contemplated herein. In view of this disclosure, one having ordinary skill in the art appreciates how to make blanks for and assemble packages having an octagonal shape with an autobottom. Any suitable adhesive can be applied to any suitable panel disclosed herein for any suitable purpose. Any suitable foldable line types are contemplated herein (e.g., perforated, creased, etc.). While, the Figs. include a legend indicating the line types of the embodiments of the Figs, any other suitable line types for the lines shown in the drawings are contemplated herein.

Figure 7:
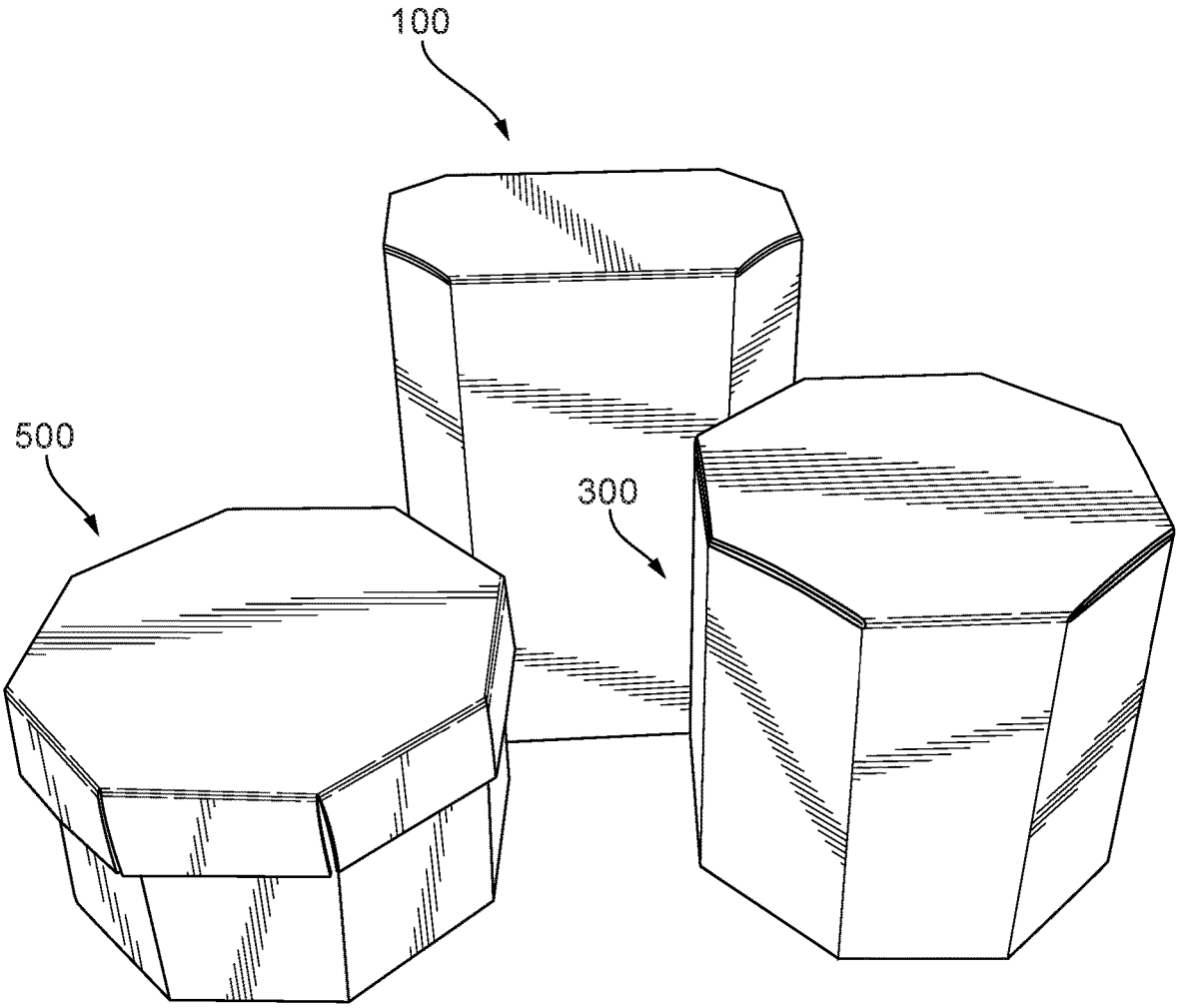
FIG. 7 is a perspective view of the embodiments of FIGS. 1A-6 shown together.

Embodiments provide a package that is easy to set up and maintain the shape. Embodiments include a unique, fully functional octagonal autobottom. Certain embodiments of this disclosure are shown in FIG. 7 next to each other.

While embodiments have been described and shown above, any suitable panels and/or other design for a blank to form a twisted package is contemplated herein. Any suitable material for use (e.g., paper, cardboard, plastic board, etc.) is contemplated herein.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A package, comprising:

an octagonal side body formed of at least eight body panels; and an autobottom connected to the octagonal side body and formed of a plurality of bottom panels each extending from a respective body panel of the at least eight body panels, wherein the autobottom connects all of the at least eight body panels together in an octagonal shape when the plurality of bottom panels are interacting with each other, wherein the at least eight body panels are connected in series by respective body fold lines between each connected body panel, the series either beginning or ending with an additional body panel connected thereto from which no bottom panel extends, wherein the plurality of bottom panels include a first, second, third, fourth, fifth, sixth, seventh, and eighth bottom panel, each extending from a respective first, second, third, fourth, fifth, sixth, seventh, and eighth body panel connected in series of the at least eight body panels, wherein the first, second, fourth, sixth, and eighth bottom panels have glue applied thereon to form the autobottom, and the third, fifth, and seventh bottom panels have no glue applied thereon to form the autobottom.

2. The package of claim 1, wherein the autobottom is configured to fully enclose a bottom opening of the package.

3. The package of claim 2, wherein the autobottom fits entirely within the octagonal shape such that no portion of the autobottom extends laterally outside of the at least eight body panels when the plurality of bottom panels are interacting with each other.

4. The package of claim 1, wherein the at least eight body panels are not the same width such that the octagonal side body forms an irregular octagon for the octagonal shape.

5. The package of claim 1, wherein at least eight of the at least eight body panels are the same width such that the octagonal side body forms a regular octagon for the octagonal shape.

6. The package of claim 1, further comprising a top configured to at least partially enclose a top opening that is defined by the at least eight body panels and is opposite relative to the bottom opening.

7. The package of claim 6, wherein the top is foldably connected to a body panel of the at least eight body panels to fold relative to the body panels to selectively cover the top opening.

8. The package of claim 7, wherein one or more body panels of the at least eight body panels includes a latching portion configured to receive a latch connected to the top to latch the top to the one or more body panels.

9. The package of claim 8, wherein each latching portion is foldably connected to the respective body panel of the one or more body panels, wherein a pair of latching portions is configured to receive a latch in a space defined between the pair of latching portions, the space being defined by side edges of each latching portion of the pair of latching portions, wherein the side edges are non-linear having a concave or zig-zag portion for receiving the latch.

10. A blank configured to form a package in accordance with any of the preceding claims.

11. A blank for a package, comprising:

at least eight body panels connected by a respective body fold line between each body panel and configured to form an octagonal shape; and a plurality of bottom panels, a respective bottom panel of the plurality of bottom panels foldably connected to a respective body panel of the at least eight body panels, wherein the plurality of bottom panels are configured to form an autobottom that at least partially forms a bottom of the package, wherein the autobottom connects all of the at least eight body panels together in an octagonal shape when the plurality of bottom panels are interacting with each other, wherein the plurality of bottom panels include a first, second, third, fourth, fifth, sixth, seventh, and eighth bottom panel, each extending from a respective first, second, third, fourth, fifth, sixth, seventh, and eighth body panel connected in series of the at least eight body panels, wherein the first, second, fourth, sixth, and eighth bottom panels have glue applied thereon to form the autobottom, and the third, fifth, and seventh bottom panels have no glue applied thereon to form the autobottom.

12. The blank of claim 11, wherein the autobottom is configured to automatically form the bottom when the body panels are moved to be in the octagonal shape.

13. The blank of claim 11, wherein the body panels each have a rectangular shape.

14. The blank of claim 11, wherein the octagonal shape is an irregular symmetric octagon, wherein the first bottom panel includes an irregular, double peak shape, wherein the second bottom panel includes straight sides that form the octagonal shape to align with each body panel, wherein the third bottom panel is an irregular shape with straight sides extending from the third body panel at an angle, wherein the fourth bottom panel is a triangle shape, wherein the fifth bottom panel has an irregular partial octagonal shape, wherein the sixth bottom panel has an irregular, double peak shape, wherein the seventh bottom panel is an irregular shape with straight sides extending from the seventh body panel at an angle similar to the third bottom panel, and wherein the eighth bottom panel is a triangle shape similar to the fourth bottom panel.

15. The blank of claim 14, wherein the first body panel has glue disposed thereon, the blank further comprising a ninth body panel foldably connected to the eighth body panel and not having a bottom panel connected thereto, wherein the ninth body panel is configured to be attached to the first body panel.

16. The blank of claim 11, wherein the octagonal shape is a regular octagon, wherein the first bottom panel includes an irregular, double peak shape, wherein the second bottom panel includes straight sides that at least partially form the octagonal shape to align with each body panel, wherein the third bottom panel is an irregular shape with straight sides extending from the third body panel at an angle, wherein the fourth bottom panel is a triangle shape, wherein the fifth bottom panel has an irregular partial octagonal shape, wherein the sixth bottom panel has an irregular, double peak shape, wherein the seventh bottom panel is an irregular shape with straight sides extending from the seventh body panel at an angle similar to the third bottom panel and a spring tab foldably connected to the seventh bottom panel, and wherein the eighth bottom panel is a triangle shape similar to the fourth bottom panel.

17. The blank of claim 16, further comprising an attachment tab foldably connected to the first body panel and configured to connect to the eighth body panel via an adhesive.

18. The blank of claim 11, further comprising:

a top panel configured to at least partially enclose a top opening that is defined by the at least eight body panels upon formation of the package and that is opposite relative to the bottom, the top panel being foldably connected to a body panel of the at least eight body panels;

a first pair of latching panels foldably connected to respective body panels adjacent the body panel to which the top panel is foldably connected; and a second pair of latching panels foldably connected to respective body panels of the at least eight body panels, the respective body panels being those body panels adjacent to respective body panels that are adjacent to the body panels to which the first pair of latching panels are connected.

19. The blank of claim 18, wherein each pair of latching panels is configured to receive a corresponding latch tab in a space defined between respective edges of each of the pair of latching panels, wherein at least two latch tabs are foldably connected to the top panel.

20. The blank of claim 11, wherein the first and second bottom panels are connected by a first foldable or frangible line and the fifth and sixth bottom panels are connected by a second foldable or frangible line.

* * * * *